US005366031A

United States Patent [19]

Rickards

[11] Patent Number: 5,366,031

[45] Date of Patent: Nov. 22, 1994

[54] AUGER HEAD ASSEMBLY AND METHOD OF DRILLING HARD EARTH FORMATIONS

[75] Inventor: Brian Rickards, Fremont, Calif.

[73] Assignee: Pengo Corporation, Union City, Calif.

[21] Appl. No.: 56,642

[22] Filed: May 3, 1993

[51] Int. Cl.[5] ..... E21B 10/40

[52] U.S. Cl. ..... 175/354; 175/386; 175/391; 299/80

[58] Field of Search ..... 175/292, 335, 354, 391; 299/80

[56] References Cited

U.S. PATENT DOCUMENTS

| | | | |
|---|---|---|---|
| 2,701,126 | 2/1955 | McClennan | 175/391 |
| 2,810,566 | 10/1957 | Parsons | 175/391 |
| 2,912,228 | 11/1959 | Kandle | 175/391 |
| 2,981,403 | 4/1961 | Goodrich | 175/391 |
| 3,508,622 | 4/1970 | Benetti et al. | 175/292 |
| 3,675,973 | 7/1972 | Mottinger . | |
| 3,693,734 | 9/1972 | Richmond | 175/391 |
| 3,763,942 | 10/1973 | Levitt | 175/391 X |
| 3,821,993 | 7/1974 | Kniff et al. . | |
| 3,841,709 | 10/1974 | Kniff et al. . | |
| 3,924,697 | 12/1975 | College . | |
| 4,201,421 | 5/1980 | Den Besten et al. . | |
| 4,202,416 | 5/1980 | Blaschke et al. | 175/292 X |
| 4,784,517 | 11/1988 | Bergqvist et al. . | |

OTHER PUBLICATIONS

Pengo Corporation MD-90 Catalog "Pengo Augers & Components For Boom Suspended & Derrick Diggers" (1990).

Texoma Catalog, p. 10.

*Primary Examiner*—Ramon S. Britts
*Assistant Examiner*—Frank S. Tsay
*Attorney, Agent, or Firm*—Townsend and Townsend Khourie and Crew

[57] ABSTRACT

An auger is provided with a boring head having an arrangement for cutting relatively hard earth formations such as rock. First and second groups of drill bits are mounted to the boring head such that when the head is rotated, each bit in those groups cuts a different path at a different height to provide more than 100% coverage of the work surface being cut, while stabilizing the auger by distributing the down force of the auger over the entire work surface. The drill bits also are orientated to ensure bit rotation at relatively large attack angles (the angle the bit forms with the work surface therebeneath) of about 50°-60° to enhance auger penetration rates without detracting from the bit sharpening effect that results from proper bit rotation.

23 Claims, 5 Drawing Sheets

AUGER HEAD ASSEMBLY AND METHOD OF DRILLING HARD EARTH FORMATIONS

BACKGROUND OF THE INVENTION

The invention relates to augers generally, and more particularly to an auger head assembly for boring rock.

Earth augers typically comprise a cutting head having cutting teeth, and spiral flighting for conveying spoil from the cutting head. However, where hard formations, such as rock, are encountered, drilling rates generally have been limited to ½ ft/hr. In addition, these conditions often cause auger damage and breakdown.

In known head assemblies for boring rock, a pair of shanks support rotatably mounted teeth. Among the drawbacks of these assemblies is that the size of the teeth and the retaining mechanism for retaining the teeth in the shank generally necessitate that adjacent teeth be substantially spaced from one other. Those spaces cause ridges to be formed between cutting teeth during excavation. It was believed that the uncut ridges would eventually break off as the head assembly continued to cut. This may be true with a fracturable rock, but when cutting in consolidated rock, such as granite, these ridges of uncut material will stop the auger completely. Even in the case where fracturable rock is encountered, these ridges end up being broken off by the shanks. This causes excessive wear and early failure to the shanks which are much more expensive than the cutting teeth. In addition, the shanks used in these assemblies generally are mirror images of one another. Thus, two teeth, one from each shank, cut along the same path. This configuration does not spread out the downforce of the machine over the entire work surface but only concentrates it on the teeth, thereby adding to increased tooth wear. Further, this configuration can result in excessive vibration causing the teeth to jump. Such vibration also is transferred back to the auger drive where it can loosen fasteners and cause hydraulic motor failure and operator fatigue.

Another problem with current shank design using cylindrical teeth is that the cutting tips of the teeth are at the same height relative to the work and, thus, engage the cutting surface at the same time. When digging in a hard material, such as rock, these teeth are forced to cut their own paths and do not work together to fracture the rock.

Although free rotation of the rotatably mounted drilling teeth in the assemblies described above is important, it often is not achieved when boring hard materials. That is, as the teeth cut into the work surface, the teeth need to rotate in the respective shank in order to undergo uniform wear to maintain their sharpness. Drilling teeth can heat up to over 300° F. when they do not rotate correctly. The heat build-up is caused by the inability of the teeth to rotate which, in turn, causes more friction that exacerbates the problem, e.g., tooth wear. Power requirements also are increased to overcome the friction. As noted above, current shank design generally does not position the teeth for optimal rotation when boring hard materials. This results in the teeth wearing out at excessive rates and penetration rate reduction.

The attack angle at which the center line of the tooth approaches the ground is another factor that relates to the performance of the auger. This angle generally has been limited to a maximum of 45° to avoid adversely affecting tooth rotation. However, this attack angle limitation restricts penetration rates and, thus, increases drilling costs.

SUMMARY OF THE INVENTION

The present invention is directed to an auger and method for boring hard earth formations that avoids the problems and disadvantages of the prior art. The auger of the present invention is provided with a drilling head having a plurality of drill bits. The bits are radially arranged such that all of the bits (except for outer gage bits) cut different paths. In this way, more than 100% coverage of the work surface can be obtained and any material left behind by one bit can be removed by another bit before that material impedes further head penetration.

Another advantageous feature of the invention is that the drill bits are arranged at different heights. In this way, when the drilling head is rotated and positioned for initial entry into the work surface, the time each drilling element begins to cut can be controlled. This height configuration, in conjunction with the radial bit arrangement described above, stabilizes the auger by distributing the downforce of the auger over the entire work surface.

The drill bits are further advantageously arranged such that proper bit rotation is achieved to provide continuous bit sharpening at relatively large drill bit attack angles (the angle formed between the rotational axis of the bit and the work surface therebeneath) of about 50°-60° to enhance auger penetration rates.

The above is a brief description of some deficiencies in the prior art and advantages of the present invention. Other features, advantages and embodiments of the invention will be apparent to those skilled in the art from the following description, accompanying drawings and appended claims.

DESCRIPTION OF THE PREFERRED EMBODIMENT

Figure 1:
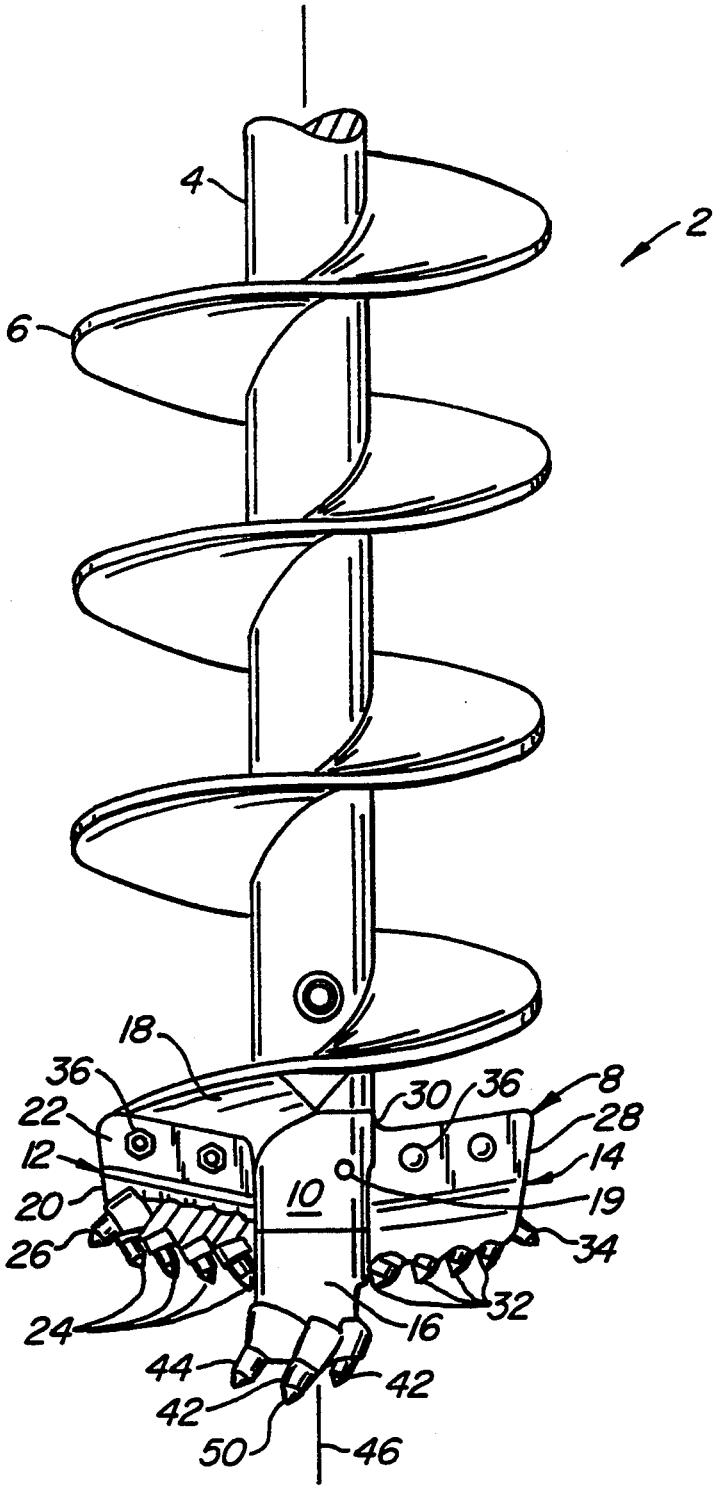
FIG. 1 is a side view of an auger constructed in accordance with the principles of the present invention.

Referring to the drawings in detail, wherein like numerals indicate like elements, FIG. 1 illustrates an auger 2 constructed in accordance with the present invention. Auger 2 includes auger shaft 4, flighting 6, and head assembly 8. Flighting 6 is helically arranged around shaft 4 to convey spoil to the surface of the area being excavated as is conventional in the art. Head assembly 8 includes a boring head 10, first and second shank plate assemblies 12, 14, and a pilot head 16. The boring head is secured to one end of the auger shaft and an end portion 18 of the flighting, such as by welding. In contrast, pilot head 16 preferably is releasably secured to boring head 10 to facilitate replacement of the pilot head. In the embodiment illustrated in FIG. 1, pilot head 16 preferably includes a male extension (not shown) that is inserted into the open end of the boring head and secured thereto with a bolt 19. However, other mechanisms can be used to releasably secure pilot head 16 to head 10. In any event, shaft 4, boring head 10, and pilot head 16 are arranged to have a common rotational axis 46.

Each shank plate assembly includes a shank plate, a bracket to mount the shank plate to the boring head, and a plurality of drilling elements, teeth, or bits which are preferably cylindrical or conical in design for drilling hard earth formations, such as rock. Specifically, shank plate assembly 12 includes shank plate 20, bracket 22, a first group of drilling elements (elements 24), which preferably are aligned in a substantially straight row, and a gage drilling element 26 positioned at the distal end of shank plate 20. Similarly, shank plate assembly 14 includes shank plate 28, bracket 30, a second group of drilling elements (elements 32), which are preferably aligned in a substantially straight row, and a gage drilling element 34 positioned at the distal end of shank plate 28. Each shank plate 20, 28 is releasably secured to a respective bracket 22, 30, for example, by a bolt-nut fastener 36 which passes through holes 38, 40 in the shank plate and bracket (see, e.g., FIG. 2). This facilitates shank plate and drilling element replacement. The brackets preferably are fixedly secured to boring head 10. Preferably, the brackets and boring head are formed as a one-piece casting.

Figure 4:
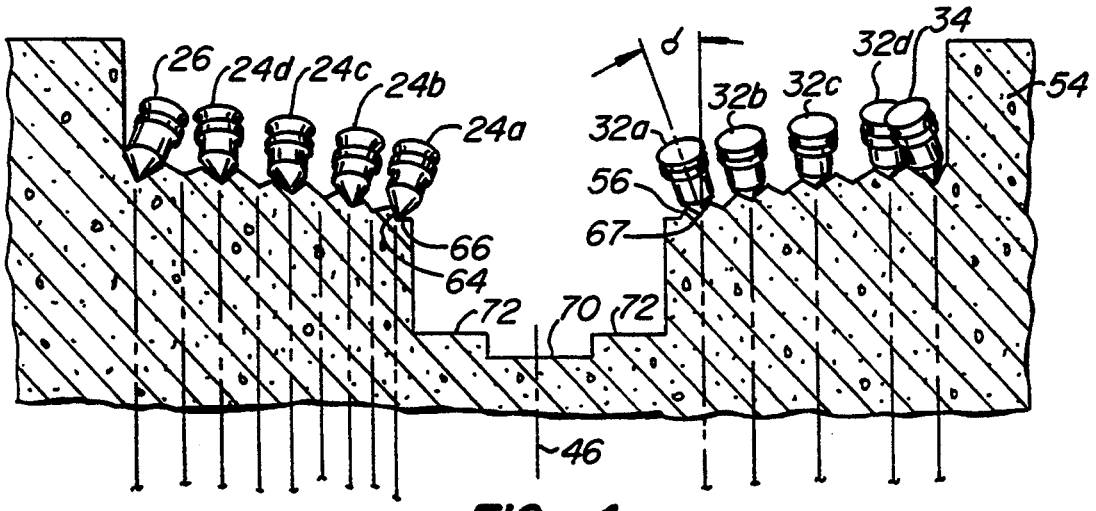
FIG. 4 illustrates the lateral cutting angle (contact angle) and relative heights of the cutting teeth of FIG. 1.
Figure 5:
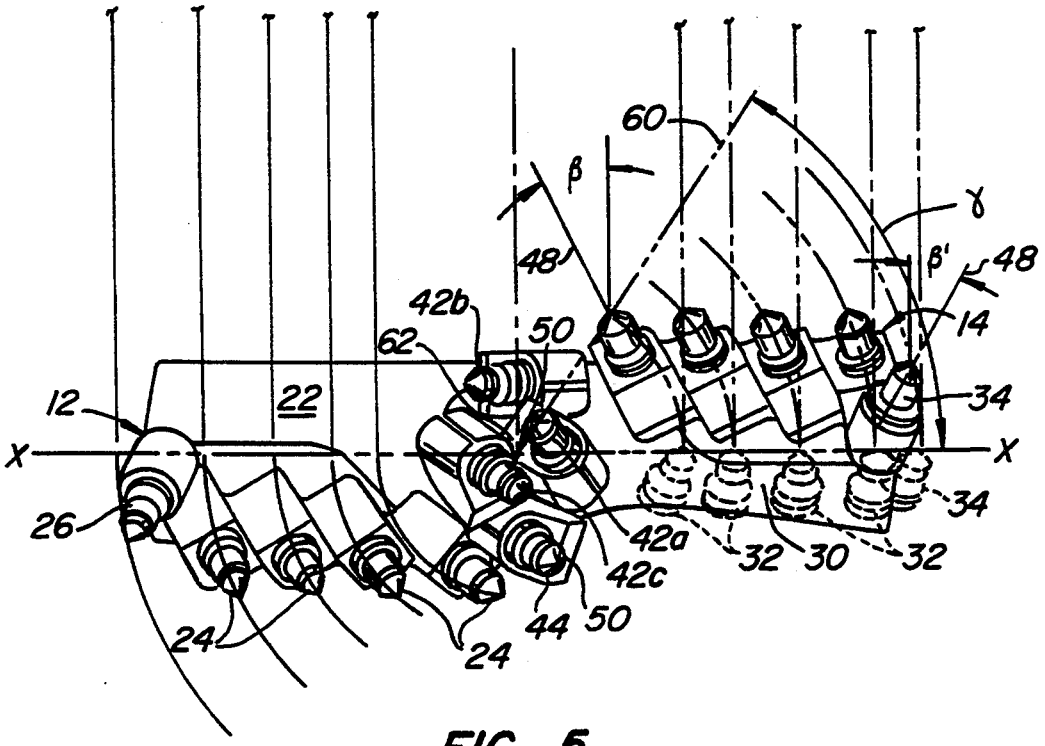
FIG. 5 is a bottom view of the auger head assembly of FIG. 1 further illustrating the angular orientation of the cutting teeth of FIG. 1.

As illustrated in FIGS. 1 and 5, pilot head 16 preferably is provided with four drilling elements, teeth, or bits, each having a terminal end spaced at a different radial distance from rotational axis 46 than the others. That is, the terminal ends of teeth 42*a*, 42*b*, and 42*c* are positioned such that the first tooth 42*a* cuts the innermost groove, the second tooth 42*b* cuts a second groove spaced radially outward from the first groove, and the third tooth 42*c* cuts a third groove spaced radially outward from the second groove. The terminal end of the fourth tooth 44 is positioned radially outward of that of the third tooth and is turned outward to cut clearance for the pilot head. These elements form leading hole 70 and clearance as indicated by numeral 72 in FIG. 4. Each drilling element 42*a*, 42*b*, and 42*c* includes a generally conical tip 50 having a rotational axis angled toward rotational axis 46. The generally conical tip 50 of the fourth drilling element, gage element 44, is arranged such that its rotational axis is angled outwardly away from rotational axis 46 to cut clearance, as discussed above.

Each of the drilling elements or bits discussed above is rotatably coupled to either one of the shank plates or the pilot head assembly as shown in the drawings. Specifically, the proximal end of each drilling element or bit is rotatably mounted within a recess formed in a block portion of either one of the shank plates or pilot head. Each bit is axially secured in a respective hole without inhibiting rotation about the rotational axis 48 of the bit as is conventional in the art. The free rotation of the drill bit is important because it permits the drill bit tip to wear down uniformly around its entire periphery so that its terminal end or point remains sharp throughout its life. At the leading or distal end of each bit, the bit has mounted therein a hard wear-resistant tip 50 consisting, for example, of a cemented hard metal carbide such as tungsten carbide. Each bit further includes a thrust transmitting shoulder 52 positioned at an intermediate point of the bit. Shoulders 52 engage the block portions discussed above for transmitting thrust from those blocks and, thus, the boring head 10, to the cutting tips of the bits. Examples of drill bits suitable for use in conjunction with the present invention (i.e., suitable for drilling rock) are described in U.S. Pat. Nos. 3,821,993 and 3,924,697, both of which are hereby incorporated by reference. The former patent noted above also discloses a suitable way in which the bit can be rotatably mounted to the block.

The radial location, relative height, and angular orientation of the cutting tips are of particular importance to the invention. Generally, these features, as will be described below, provide more than 100% coverage of the work surface by the drilling elements, stabilize the auger by distributing the downforce of the auger over the entire work surface, ensure rotation of drilling elements, and enhance auger penetration rates.

Referring to FIGS. 1, 4, and 5, each drilling element 24, 32 is radially spaced from the rotational axis 46 of the auger and head assembly by a different distance. Thus, shank plates 20 and 28 are not mirror images, as they differ in the radial position of their drilling element receiving holes and drilling elements. With this construction, all of the drilling elements on the shank plate, except for the outer gage elements 26, 32 cut different paths, which prevents ridges from forming between drilling elements that otherwise can cause excessive wear to the drilling elements and shanks. In other words, this arrangement permits the drilling elements to cover more than 100% of the work surface. As illustrated in FIG. 4, the preferred sequence of drilling elements, in order of closest to farthest from the rotational axis 46, alternates between a drilling element from the group of drilling elements 24 and a drilling element from the group of drilling elements 32. Outer gage drilling elements 26 and 24 are equidistantly spaced from rotational axis 46. These gage drilling elements provide clearance for the flighting and outer portions of the shank plates, as discussed above. These gage elements also form a wall in the hole which stabilizes the auger and maintains the boring action in a straight path in the event that one side of the head assembly encounters an obstruction. Since these gage elements have to cut the side and bottom of the hole, and are subjected to the most extreme conditions, they are equidistantly spaced from axis 46 to cut the same groove.

Figure 3:
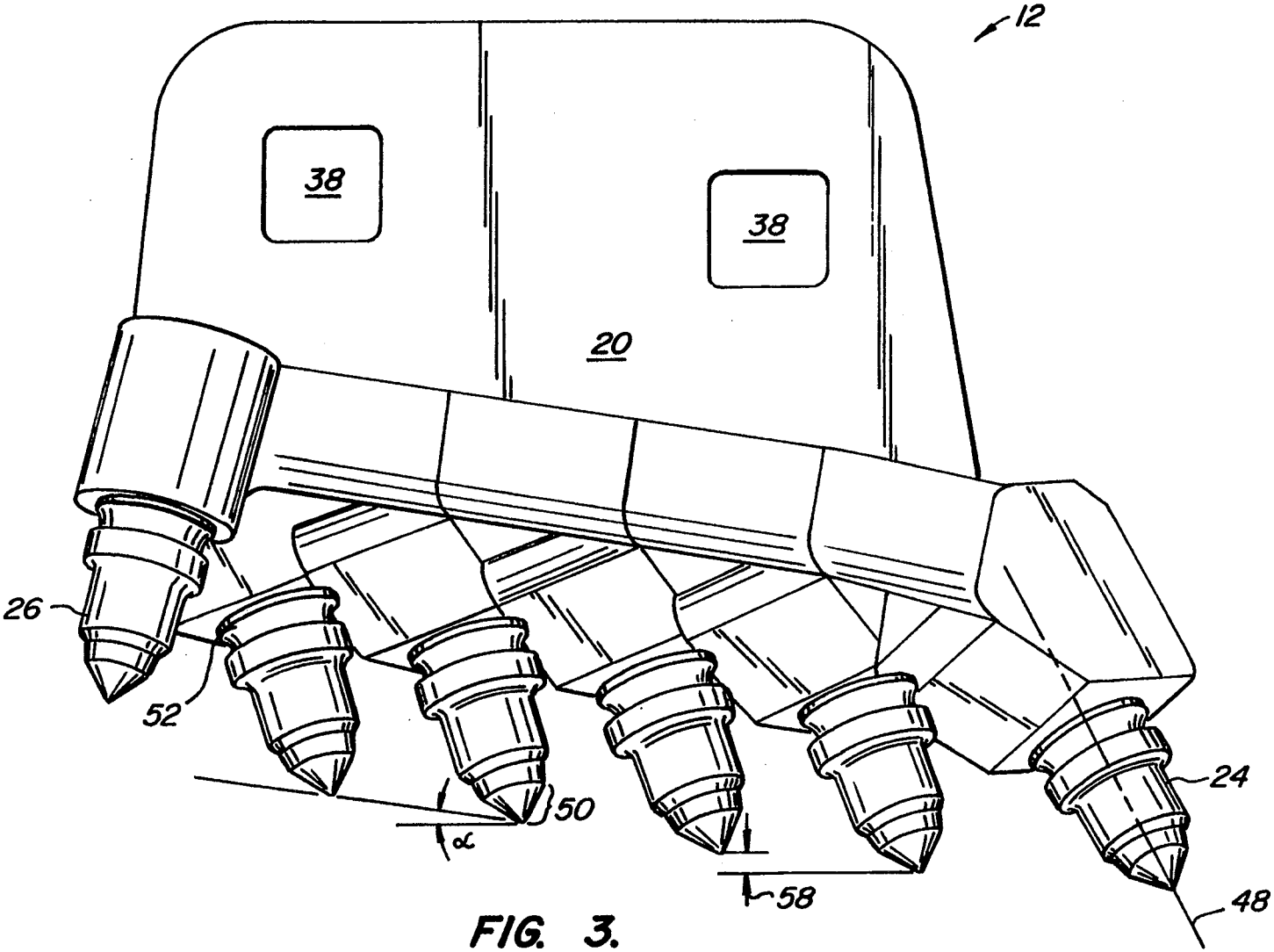
FIG. 3 is a front view of the shank plate assembly illustrated in FIG. 2.

Referring to FIGS. 3 and 4, the terminal ends of cutting tips 50 of drilling elements 24 and 32, are located at different heights in order to provide a timing mechanism to control the time each drilling element contacts the work surface when the head assembly is rotated for initial entry into rock 54. It has been found that the angle ($\alpha$) between the terminal ends of any two drilling element tips in each shank and the horizontal, shown perpendicular to rotational axis 46 and designated by reference character "H" should be in the range of 5° to 45° to provide optimum results in distributing the downforce of the auger and achieving 100% coverage of the work surface. Merely to exemplify a preferred arrangement, the following example is provided. When the length of the cutting tips 50 is about $\frac{1}{4}''$, the vertical distance 58 between adjacent cutting tips 24 or adjacent cutting tips 32 preferably is about $\frac{1}{4}''$. This distance is shown with reference to cutting teeth 24 in FIG. 3. This vertical spacing results in vertical cutting increments of about ⅛" from the innermost to outermost groove formed in the work surface (see FIG. 4).

In operation, the innermost drilling element (e.g., element 24*a*) starts a cutting path to form a first generally annular groove (e.g., groove 66). Then the innermost drilling element 32*a* on the other shank begins to carve a groove (groove 67) immediately adjacent the first groove, while ripping the ridge 56 of material that was left by drill bit 24*a*. Then, drilling element 24*b* cuts a third groove adjacent the second groove, while ripping any ridge left behind by drill bit 32*a*. This sequence continues in the order of bit 32*b*, 24*c*, 32*c*, 24*d*, and 32*d*, as apparent from FIG. 4, to form a set of generally concentric annular grooves. This configuration and sequence is preferred for 9, 16, 18, and 20-inch diameter head assemblies. However, in 24 inch and large diameter head assemblies, it is preferred to have adjacent teeth on a shank at the same height and radially spaced such that two adjacent teeth on one shank simultaneously contact the work surface, then two adjacent teeth on the other shank simultaneously contact the work surface, followed by two adjacent teeth on the one shank and so on. Of course, drilling elements 42 and 44 in the pilot head precede the drilling elements in the shanks to cut starting hole 70 and prevent the auger from walking (i.e., moving laterally relative to the hole). It also is noted that pilot head drilling elements 42*a* and 42*b* are at the same height; however, this is not a problem since all of the initial downforce will be on these two teeth so that they will quickly sink into the rock. Drilling element 42*c* and gage element 44 also are at the same height, but are higher than elements 42*a* and 42*b* so as to cut the area designated with reference numeral 72 in FIG. 4.

Referring to FIGS. 4 and 5, the axial, radial, and contact angles of the drilling elements are shown. It should be understood, however, that the cross section of rock 54 shown in FIG. 4 is not a direct view of the drilling elements as they cut. This would not show all of the drilling elements in a true view, which is shown in FIG. 4. Specifically, FIG. 4 shows at what angle each drilling element would be as it passes line X—X (see FIG. 5), which intersects rotational axis 46 of the auger and head assembly, and is parallel to the horizontal when axis 46 is positioned along the vertical, looking at ground level. In other words, the drilling elements shown in FIG. 5 are projected back along line X—X and projected up so they are shown in FIG. 4 as they pass through line X—X. In FIG. 5, drilling elements 32 and 34 are shown in phantom projected back to line X—X, as described above. Although not shown, drilling elements 24 and 26 would be similarly projected back.

Referring to FIGS. 3 and 5, drilling elements 24 and 32 are each angled inwardly toward the proximal end of their respective shank plate. As illustrated in FIG. 5, these elements are angled inwardly by an axial angle ($\beta$). There are several factors used to determine this angle which varies from 10°-55°, depending on the radial angle of the particular drilling element. Angle ($\beta$) is formed between the rotational axis 48 of a respective drilling element and a line extending from the terminal end of the drilling element and perpendicular to line X—X, as shown in FIG. 5. Line X—X is shown generally parallel to the radial direction of brackets 22, 30 and shank plates 20, 28. The radial angle ($\gamma$) is formed between line X—X and line 60, which passes through center 62 or rotational axis 46 of boring head 10 and extends to the terminal end of a particular drilling element. If the axial angle is equal to the radial angle, then the third angle, the contact angle ($\delta$), will be zero. The contact angle is the angle at which a particular drilling element laterally engages the outer side wall of the groove which it cuts. See outer side wall 64 and groove 66 in FIG. 4, for example. Thus, although drilling elements 24 and 32 are angled toward the proximal end of the shank plates adjacent boring head 10, the radial angle of these elements, which decreases with distance from head 10, causes the drilling elements to be angled outwardly against the outside wall of a respective groove. That is, the shank plates are offset from radial line 60, as shown in FIG. 5.

It has been found that a contact angle of about 0° to 20° in the present invention provides optimum results for the desired drilling element rotation in various types of rock. When the contact angle is greater than 20° the sides of the cutting tips contact the work surface, dulling the cutting tips and inhibiting rotation. Because the drilling elements are generally cylindrical or conical, rotation of the elements is critical to the performance of the auger. Thus, it is important that the contact angle be about 0°-20° so that the drilling elements rotate properly and undergo a self-sharpening action that keeps the auger penetrating into the work surface.

Another factor used in determining the correct axial angle is the cutting path of the tooth. As illustrated in FIG. 5, the drilling elements must be sufficiently inwardly angled relative to the shank plates to cut the generally concentric annular grooves such that more than 100% coverage of the work surface is obtained and ridges formed between grooves are removed. Based on the contact angle range described above, radial position of a particular drilling element, and desired work surface coverage, it has been found that an axial angle of about 10°-55° provides optimum results for the head assembly constructed in accordance with the present invention.

Figure 2:
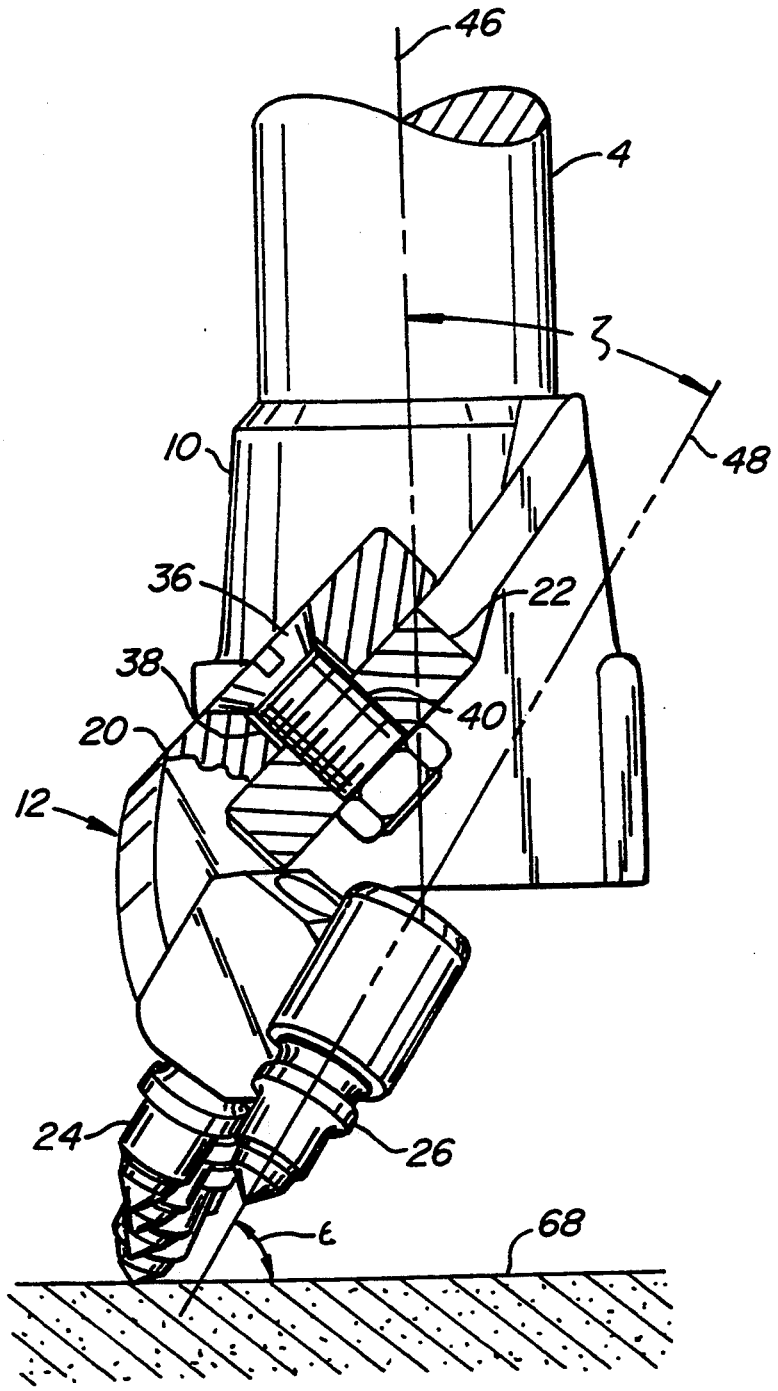
FIG. 2 illustrates one of the auger head shank plate assemblies illustrated in FIG. 1 rotated about 90°.

The attack angle ($\epsilon$) of the drilling elements also is important. This angle affects the penetration rate of the drilling elements, for example. The attack angle is the angle formed between the rotational axis of a drilling element (i.e., element 24, 26, 32, or 34) and the work surface, e.g., rock surface 68. This angle is shown in FIG. 2 and designated with reference character "$\epsilon$". It has been found that a 45° attack angle, which is the maximum used in other types of drilling arrangements, generally does not provide a large enough relief angle. The relief angle is the angle formed between the cutting tip (e.g., cutting tip 50) of a drilling element and the work surface (e.g., rock surface 68). The relief angle must be large enough to keep the terminal end (or point) of the drilling element engaging the work surface at all times. Otherwise, the sides of the drilling element will contact the work and undergo undesirable wear that adversely affects the rotational ability of the element. An attack angle of °-60° provides correct bit rotation for the drilling element arrangement of the present invention (55° provides optimal results). Beyond this range, the cutting tip sides are unevenly worn, which inhibits rotation and dulls the tip. It is believed that correct rotation occurs with the described, relatively large, 50°-60° attack angle, which allows greater penetration rates and, thus, faster boring rates, because of the overall orientation of the drilling elements which takes into account the axial, radial, and contact angles (discussed above), for example. This 50°–60° attack angle can be provided by arranging the rotational axes (48) of the drilling elements relative to the rotational axis 46 of the auger head assembly, such that an angle ($\zeta$) of 30°–40° is formed therebetween (FIG. 2).

In contrast to drilling elements 24 and 32, gage elements 26 and 34 are angled outwardly and away from the proximal end of their respective shank plate. As illustrated in FIG. 5, this angle ($\beta'$) is about 20°–30°, and preferably about 25°. Angle $\beta'$ is measured the same way as angle $\beta$, discussed above.

Pilot drilling elements 42 and gage element 44 also are provided with attack, axial, radial, and contact angles which are selected as described above.

Figure 6:
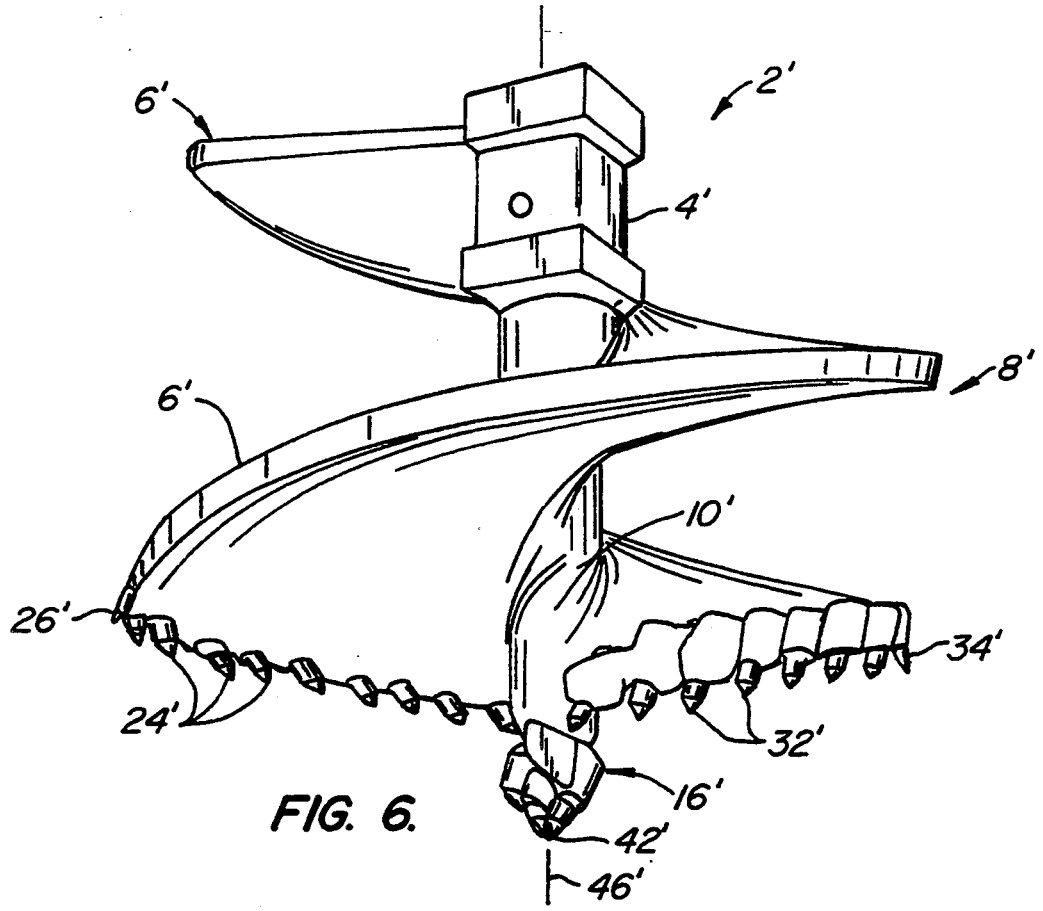
FIG. 6 is a side view of another embodiment of an auger in accordance with the principles of the present invention.
Figure 7:
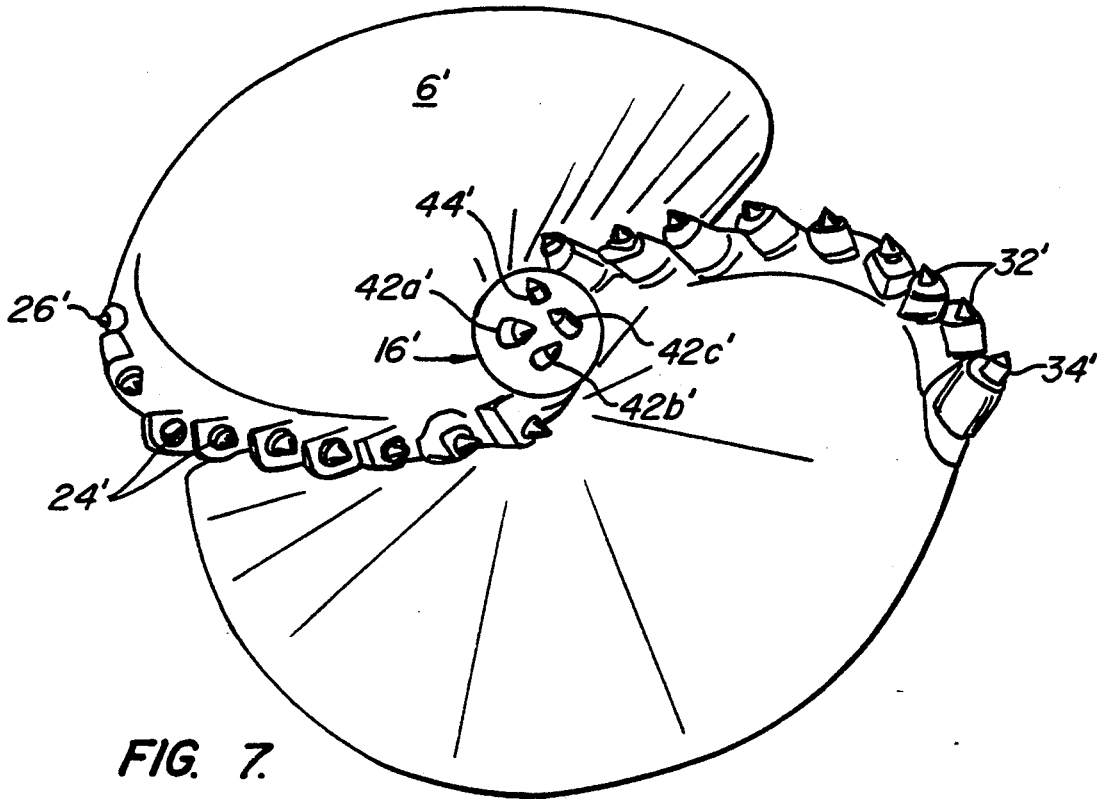
FIG. 7 is a bottom view of the auger head assembly of FIG. 6.

Referring to FIGS. 6 and 7, a further embodiment of the auger is illustrated in accordance with the principles of the present invention. Auger 2' includes auger shaft 4', flighting 6', a first group of drilling elements 24', a second group of drilling elements 32', gage elements 26' and 34', pilot head 16' having inner drilling elements 42', and outer gage drilling element 44'. This embodiment essentially only differs from that illustrated in FIG. 1 in that the drilling elements 24', 26', 32', and 34' are arranged along the curvilinear path of the perimeter of the end portion of the flighting and are directly secured to the flighting by welding, for example. That is, this embodiment does not incorporate the removably attached and replaceable shank plate design illustrated in FIG. 1. However, each of the drilling elements depicted in FIGS. 6 and 7 is rotatably mounted in the flighting or pilot head in the same way as in the embodiment illustrated in FIG. 1. In addition, the radial position, height, and angular orientation (axial, radial, contact, and attack angles) of these drilling elements corresponds to that of the drilling elements described with reference to FIGS. 1–5. Further, in this embodiment, pilot head 16' preferably is releasably connected to boring head 10' through a threaded interconnection. More specifically, pilot head 16' preferably includes a projection (not shown) with threads on its outer circumference that engage threads formed on the inner wall of a generally cylindrical element that is secured, such as by welding, to the inner wall or end of generally cylindrical head 10'. Boring head 10' is fixedly secured to auger shaft 4' and, thus, can be considered as an extension or part of the shaft. As in the embodiment illustrated in FIG. 1, shaft 4' boring head 10', and pilot head 16' have a common rotational axis 46'.

With the auger construction described above, drilling rates have been greatly improved. The following test data (wherein Est. corresponds to estimated) shows actual drilling rates achieved for various earth formations. Table 1 shows the results of drilling granite with the invention wherein an average 6 in/min drilling rate was achieved over a 17 min interval.

TABLE 1

| | |
|---|---|
| Material | Granite |
| Est. Kelly Torque (ft/lbs) | 39,000 |
| Est. Downforce (lbs) | 26,000 |
| Auger | 24" (Pengo HRR-30 holder welded into flights) |
| Drilling RPM | 30+ |
| Time Drilling | 17 min |
| Depth of Hole (ft) | 8½ |
| Wear on Teeth | no visible wear |
| Type of Tooth | Kennemetal C3LR (carbide tipped alloy steel - bullet tooth) |

TABLE 1-continued

| | |
|---|---|
| Drilling Rate (in/min) | 6 |

Table 2 shows the results of drilling blue granite wherein an average 0.4 in/min drilling rate was achieved over a 3 hour interval.

TABLE 2

| | |
|---|---|
| Material | Blue Granite |
| Est. Kelly Torque (ft/lbs) | 10,960 |
| Est. Downforce (lbs) | 1,900 |
| Auger | 18" (Pengo 18-MDOBH head with shanks) |
| Drilling RPM | 12–18 |
| Time Drilling | 3 hrs |
| Depth of Hole (ft) | 6 |
| Wear on Teeth | all teeth worn out (4 teeth broke do to uneven drilling and ledges formed by crevise in rock) |
| Type of Tooth | Kennemetal C3LR (carbide tipped alloy steel - bullet tooth) |
| Drilling Rate (in/min) | 0.4 |

Table 3 shows an average drilling rate of 1.23 in/min for black oil rock over a 6½ hr interval.

TABLE 3

| | |
|---|---|
| Material | Black Oil Rock |
| Est. Kelly Torque (ft/lbs) | not known |
| Est. Downforce (lbs) | 3,100 |
| Auger | 24" (Pengo HRR Auger holders welded into flights) |
| Drilling RPM | 22–28 |
| Time Drilling | 6 hrs 30 min |
| Depth of Hole (ft) | 40 |
| Wear on Teeth | 38 teeth worn out (even wear on most teeth - some teeth seized up causing flat spots) |
| Type of Tooth | Kennemetal C3LR (carbide tipped alloy steel - bullet tooth) |
| Drilling Rate (in/min) | 1.23 |

Table 4 shows an average drilling rate of 0.4 in/min for drilling red limestone and white sandstone over a 3 hour period.

TABLE 4

| | |
|---|---|
| Material | Red Limestone and White Sandstone |
| Est. Kelly Torque (ft/lbs) | 9,200 |
| Est. Downforce (lbs) | 2,100 |
| Auger | 16" (Pengo 16-MD-10460 Auger with 16" shanks) |
| Drilling RPM | 15–20 |
| Time Drilling | 3 hrs |
| Depth of Hole (ft) | 6 |
| Wear on Teeth | minimal |
| Type of Tooth | Kennemetal C3LR (carbide tipped alloy steel - bullet tooth) |
| Drilling Rate (in/min) | 0.4 |

Table 5 shows an average 4.8 in/min drilling rate for blue slate and grey flint over a 15 min interval.

TABLE 5

| | |
|---|---|
| Material | Blue Slate and Grey Flint |
| Est. Kelly Torque (ft/lbs) | 9,200 |
| Est. Downforce (lbs) | 2,300 |
| Auger | 16" (Pengo 16-MD-10460 Auger with 16" shanks) |
| Drilling RPM | 15–20 |

TABLE 5-continued

| | |
|---|---|
| Time Drilling | 15 min |
| Depth of Hole (ft) | 6 |
| Wear on Teeth | 2 outside worn |
| Type of Tooth | Kennemetal C3LR (carbide tipped alloy steel - bullet tooth) |
| Drilling Rate (in/min) | 4.8 |

Tables 6 and 7 show comparative data for basalt and granite (Table 6) and flintrock (Table 7). Results from a conventional auger appear in col. A, while results from using an auger constructed in accordance with the present invention appear in col. B.

TABLE 6

| | Column A | Column B |
|---|---|---|
| Material | Basalt and Granite | Basalt and Granite |
| Est. Kelly Torque (ft/lbs) | 40,000 | 40,000 |
| Est. Downforce (lbs) | 20,000 | 20,000 |
| Auger | 20" (Pengo HDOBH head with 20XX shanks) | 20" (Pengo HDOBH head with 20" shanks) |
| Drilling RPM | 60+ | 30+ |
| Time Drilling | 2 hrs 30 min | 55 min |
| Depth of Hole | 14 in | 7 ft 6 in |
| Wear on Teeth | all 6 worn out (replaced 6 1656 teeth during test) | minimal (some steel wash, excellent rotation, even wear) |
| Type of Tooth | Pengo 1656, 1658 (carbide tipped alloy steel - flat tooth) | Kennemetal C3LR (carbide tipped alloy steel - bullet tooth) |
| Drilling Rate (in/min) | 0.09 | 1.63 |

As can be seen from the above, the auger constructed in accordance with the present invention provided an average drilling rate of 1.63 in/min, while the compared head provided an average 0.09 in/min drilling rate. This corresponds to an increase of more than 1800%.

TABLE 7

| | Column A | Column B |
|---|---|---|
| Material | Flintrock | Flintrock |
| Est. Kelly Torque (ft/lbs) | 9,200 | 9,200 |
| Est. Downforce (lbs) | 2,300 | 2,300 |
| Auger | Alaskaug 16" Duplex | 16" (Pengo 16-MD-10460 Auger with 16" shanks) |
| Drilling RPM | 15–20 | 15–20 |
| Time Drilling | 18 hrs | 2 hrs 15 min |
| Depth of Hole (ft) | 3 | 6 |
| Wear on Teeth | carbides worn out (extreme heat froze the allen bolt used change the teeth on holders) | Broke 4 teeth |
| Type of Tooth | Alaskaug No. 1030 (carbide tipped, alloy steel cutting teeth) | Kennemetal C3SR (carbide tipped alloy steel - bullet tooth) |
| Drilling Rate (in/min) | 0.03 | 0.53 |

As can be seen from the above, the auger constructed in accordance with the present invention provided an average drilling rate of 0.53 in/min, while the compared head provided an average 0.03 in/min drilling rate. This corresponds to an increase of about 1770% in drilling rate. The above is a detailed description of a particular embodiment of the invention. It is recognized that departures from the disclosed embodiment may be made within the scope of the invention and that obvious modifications will occur to a person skilled in the art. The full scope of the invention is set out in the claims that follow and their equivalents. Accordingly, the claims and specification should not be construed to unduly narrow the full scope of protection to which the invention is entitled.

What is claimed is:

1. An auger shank assembly for drilling rock, said shank assembly comprising:

a shank plate having a proximal end and a distal end, said proximal end adapted for mounting to the head of an auger; and a group of drilling elements, each including a proximal end rotatably coupled to said shank plate and a distal end adapted for drilling into rock, said drilling elements being arranged in a row that extends between said proximal and distal ends, each drilling element being angled toward the proximal end of said shank plate.

2. The shank assembly of claim 1 wherein said drilling elements are angled at least about 10° toward the proximal end of said shank plate.

3. The shank assembly of claim 1 further including a gage drilling element that is rotatably coupled to said shank plate in the vicinity of the shank plate distal end and angled away from the proximal end of the shank plate.

4. An auger head assembly comprising;

a head member having a rotational axis;

first and second shank plates, each shank plate having a proximal end coupled to said head member and a distal end; and first and second groups of drilling elements, said first group of drilling elements being rotatably coupled to said first shank plate and said second group of drilling elements being rotatably coupled to said second shank plate, each drilling element in said first and second groups being radially spaced from said rotational axis a distance different from the other drilling elements in said first and second groups; and each drilling element having a rotational axis that forms an angle with a line that passes through the rotational axis of the drilling element and is parallel to the rotational axis of said head member, said angle being 30° to 40° such that when the rotational axis of said head member is positioned along a vertical, the rotational axis of a respective drilling element forms an attack angle of 50°–60° with a cutting surface in a horizontal plane.

5. The assembly of claim 4 wherein the sequence of drilling elements in order of closest to farthest from said rotational axis alternates between a drilling element from the first group and a drilling element from the second group.

6. The assembly of claim 4 wherein said angle, formed between said drilling element rotational axis and said line, is about 35°.

7. The assembly of claim 4 wherein said angle, formed between said drilling element rotational axis and said line, is less than 40° and said attack angle is greater than 50°.

8. An auger head assembly comprising:

a head member having a rotational axis;

first and second shank plates, each shank plate having a proximal end coupled to said head member and a distal end; and first and second groups of drilling elements, said first group of drilling elements being rotatably coupled to said first shank plate and said second group of drilling elements being rotatably coupled to said second shank plate, each drilling element in said first and second groups being radially spaced from said rotational axis a distance different from the other drilling elements in said first and second groups; and said first group of drilling elements being arranged such that a line extending radially from and substantially perpendicular to said rotational axis and beneath said first group of drilling elements forms an angle of at least 5° with a line that passes through the terminal point of the distal end of any two drilling elements in the first group.

9. The assembly of claim 8 wherein the distance between the terminal point of the distal end of each drilling element in said first group and said radially extending line increases from the drilling element closest to said rotational axis to the drilling element furthest from said rotational axis.

10. The assembly of claim 8 wherein the sequence of drilling elements in order of closest to farthest from said rotational axis alternates between a drilling element from the first group and a drilling element from the second group.

11. The assembly of claim 9 wherein said second group of drilling elements are arranged such that a line extending radially from and substantially perpendicular to said rotational axis and beneath said second group of drilling elements forms an angle of at least 5° with a line that passes through the terminal point of the distal end of any two drilling elements in the second group.

12. The assembly of claim 11 wherein the distance between the terminal point of the distal end of each drilling element in said second group and said radially extending line increases from the drilling element closest to said rotational axis to the drilling element furthest from said rotational axis.

13. The assembly of claim 12 wherein said first and second groups of drilling elements each are arranged in a substantially straight line.

14. An auger head assembly comprising:

a head member having a rotational axis;

first and second shank plates, each shank plate having a proximal end coupled to said head member and a distal end; and first and second groups of drilling elements, said first group of drilling elements being rotatably coupled to said first shank plate and said second group of drilling elements being rotatably coupled to said second shank plate, each drilling element in said first and second groups being radially spaced from said rotational axis a distance different from the other drilling elements in said first and second groups; and each of the first and second groups of drilling elements being aligned in a row, the drilling elements of said first group being oriented such that their distal ends are angled toward the proximal end of said first shank plate, and the drilling elements of said second group being oriented such that their distal ends are angled toward the proximal end of said second shank plate.

15. The assembly of claim 14 further including first and second gage drilling elements, each gage drilling element being rotatably coupled to one of said shank plates, said first gage drilling element being positioned in the vicinity of the distal end of said first shank plate and angled away from the proximal end of said first shank plate, and said second gage drilling element being positioned in the vicinity of the distal end of said second gage drilling element and angled away from the proximal end of said second shank plate.

16. The assembly of claim 14 wherein the rotational axes of said drilling elements each forms an angle of at least 10° with a line extending radially from and perpendicular to the rotational axis of said head member.

17. The assembly of claim 14 wherein the radial angle, measured between a first line passing through the rotational axis of the head member and the distal end of one of the drilling elements of said first group and a second line extending radially from and perpendicular to the rotational axis of said head member, decreases when measured with respect to the drilling element in said first group closest to the rotational axis of the head member to the drilling element in said first group farthest from the rotational axis of the head member on one of said shank plates.

18. The assembly of claim 14 wherein the sequence of drilling elements in order of closest to farthest from said rotational axis alternates between a drilling element from the first group and a drilling element from the second group.

19. An auger comprising:

a shaft having a first end and a second end;

a head member coupled to the second end of said shaft for rotation therewith about a rotational axis;

a support member coupled to said head member; and a plurality of drilling elements, each including a proximal end rotatably coupled to said support member and a distal end adapted for drilling into rock, each drilling element being spaced from said rotational axis a distance different from the other drilling elements, and each drilling element having a rotational axis that forms an angle with a line that passes through the rotational axis of the drilling element and is parallel to the rotational axis of said head member, said angle being 30° to 40° such that when said rotational axis of said head member is positioned along a vertical, the rotational axis of a respective drilling element forms an attack angle of 50°–60° with a cutting surface in a horizontal plane.

20. The auger of claim 19 wherein said angle, formed between said drilling element rotational axis and said line, is about 35°.

21. The auger of claim 19 wherein said support member has a generally helical configuration for conveying spoil toward the first end of said shaft.

22. The auger of claim 21 further including flighting wrapped around said shaft, said flighting having a helical configuration for conveying spoil from said support member toward the first end of said shaft.

23. The assembly of claim 19 wherein said angle, formed between said drilling element rotational axis and said line, is less than 40° and said attack angle is greater than 50°.

* * * * *